US008590217B2

(12) United States Patent
Gleeson et al.

(10) Patent No.: US 8,590,217 B2
(45) Date of Patent: Nov. 26, 2013

(54) FRAMED WALL CONSTRUCTION AND METHOD

(75) Inventors: James Gleeson, North Curl Curl (AU); Roger Pecnik, Yowie Bay (AU)

(73) Assignee: James Hardie Technology Limited, Dublin (IE)

( * ) Notice: Subject to any disclaimer, the term of this patent is extended or adjusted under 35 U.S.C. 154(b) by 347 days.

(21) Appl. No.: 12/532,348

(22) PCT Filed: Mar. 20, 2008

(86) PCT No.: PCT/AU2008/000411
§ 371 (c)(1),
(2), (4) Date: Sep. 21, 2009

(87) PCT Pub. No.: WO2008/113136
PCT Pub. Date: Sep. 25, 2008

(65) Prior Publication Data

US 2010/0101159 A1 Apr. 29, 2010

(30) Foreign Application Priority Data

Mar. 21, 2007 (AU) ..... 2007901491

(51) Int. Cl.

| | |
|---|---|
| ***E04B 1/00*** | (2006.01) |
| *E02D 19/00* | (2006.01) |
| *E04B 1/70* | (2006.01) |
| *E04C 2/32* | (2006.01) |
| *E04F 17/00* | (2006.01) |

(52) U.S. Cl.
USPC ..... 52/105; 52/169.5; 52/302.3; 52/481.1

(58) Field of Classification Search
USPC ..... 52/105, 169.5, 302.1, 302.3, 481.1
See application file for complete search history.

(56) References Cited

U.S. PATENT DOCUMENTS

| | | | | |
|---|---|---|---|---|
| 331,469 | A | 12/1885 | Baker | |
| 1,440,358 | A | 12/1922 | Whetstone | |
| 1,630,801 | A | 5/1927 | Parsons | |
| 1,698,557 | A | 1/1929 | O'Brien | |
| 3,219,401 | A | 11/1965 | Mapson | |
| 3,318,056 | A * | 5/1967 | Thompson | 52/105 |
| 3,323,819 | A | 6/1967 | Barker | |

(Continued)

FOREIGN PATENT DOCUMENTS

| | | |
|---|---|---|
| AU | 90831 | 8/1985 |
| AU | 95374 | 2/1987 |

(Continued)

OTHER PUBLICATIONS

Design U.S. Appl. No. 29/351,069 entitled "Building Element" filed Nov. 30, 2009; Inventor: D. Southwell.

(Continued)

*Primary Examiner* — Brian Glessner
*Assistant Examiner* — Joseph J Sadlon
(74) *Attorney, Agent, or Firm* — Knobbe Martens Olson & Bear, LLP

(57) ABSTRACT

A framed wall construction (10) includes a generally vertically orientated frame (12). A substantially planar layer of a moisture barrier (21) having a generally water-resistant front surface is fixedly attached to substantially cover the frame (12). To complete the wall construction, an outer cladding material (22) is secured to cover the moisture barrier (21).

17 Claims, 13 Drawing Sheets

(56) References Cited

U.S. PATENT DOCUMENTS

| | | | | |
|---|---|---|---|---|
| 3,481,087 | A * | 12/1969 | Stafford | 52/2.19 |
| 3,481,093 | A | 12/1969 | Davidson | |
| D216,836 | S | 3/1970 | Faulkner et al. | |
| 3,561,177 | A * | 2/1971 | Agro et al. | 52/169.14 |
| D234,437 | S | 3/1975 | Craik | |
| 3,869,295 | A | 3/1975 | Bowles et al. | |
| D237,269 | S | 10/1975 | Edwards | |
| D237,271 | S | 10/1975 | Edwards | |
| 3,986,312 | A | 10/1976 | Calhoun et al. | |
| 4,052,829 | A | 10/1977 | Chapman | |
| 4,076,884 | A | 2/1978 | Riley et al. | |
| 4,366,657 | A | 1/1983 | Hopman | |
| 4,373,957 | A | 2/1983 | Pedersen | |
| D275,705 | S | 9/1984 | Gabriel | |
| 4,490,072 | A * | 12/1984 | Glasser | 405/45 |
| 4,680,911 | A | 7/1987 | Davis et al. | |
| 4,686,803 | A * | 8/1987 | Couderc et al. | 52/97 |
| 4,840,515 | A * | 6/1989 | Freese | 405/45 |
| 4,895,598 | A | 1/1990 | Hedberg et al. | |
| 4,943,185 | A * | 7/1990 | McGuckin et al. | 405/45 |
| 4,963,430 | A | 10/1990 | Kish et al. | |
| 4,984,384 | A * | 1/1991 | Kaufmann | 47/9 |
| 5,052,161 | A * | 10/1991 | Whitacre | 52/385 |
| 5,117,600 | A | 6/1992 | Yerushalmi et al. | |
| 5,242,736 | A | 9/1993 | Van Erden et al. | |
| 5,256,007 | A * | 10/1993 | Allen | 405/302.4 |
| 5,397,631 | A | 3/1995 | Green et al. | |
| 5,473,847 | A | 12/1995 | Crookston | |
| 5,622,556 | A | 4/1997 | Shulman | |
| 5,724,783 | A | 3/1998 | Mandish | |
| 5,732,520 | A | 3/1998 | Maietta | |
| 5,736,594 | A | 4/1998 | Boles et al. | |
| 5,747,142 | A | 5/1998 | Bleasdale | |
| 5,820,296 | A * | 10/1998 | Goughnour | 405/43 |
| 5,960,598 | A | 10/1999 | Tamlyn | |
| 5,974,748 | A | 11/1999 | Sciuga et al. | |
| 6,018,924 | A | 2/2000 | Tamlyn | |
| 6,030,447 | A | 2/2000 | Naji et al. | |
| 6,108,992 | A * | 8/2000 | Shaw | 52/302.3 |
| 6,199,334 | B1 * | 3/2001 | Malloy | 52/309.17 |
| 6,279,284 | B1 | 8/2001 | Moras | |
| D448,488 | S | 9/2001 | Chaffiotte et al. | |
| 6,298,620 | B1 | 10/2001 | Hatzinikolas | |
| 6,341,458 | B1 | 1/2002 | Burt | |
| 6,355,333 | B1 | 3/2002 | Waggoner et al. | |
| D456,911 | S | 5/2002 | Janesky | |
| 6,449,915 | B1 | 9/2002 | Park | |
| 6,460,311 | B1 | 10/2002 | Ito | |
| 6,510,667 | B1 | 1/2003 | Cottier et al. | |
| 6,516,580 | B1 | 2/2003 | Maietta | |
| 6,672,016 | B2 | 1/2004 | Janesky | |
| 6,695,535 | B1 | 2/2004 | Lazes | |
| 6,701,685 | B2 | 3/2004 | Rippey | |
| 6,729,093 | B2 * | 5/2004 | Zambelli et al. | 52/405.1 |
| D491,677 | S | 6/2004 | Barnett | |
| 6,758,017 | B2 | 7/2004 | Young | |
| 6,761,006 | B2 * | 7/2004 | Lubker, II | 52/302.1 |
| 6,802,668 | B2 | 10/2004 | Parker | |
| D498,856 | S | 11/2004 | Froech | |
| 6,877,288 | B2 * | 4/2005 | Shirota | 52/416 |
| 6,880,299 | B2 * | 4/2005 | Martin | 52/105 |
| 6,990,775 | B2 | 1/2006 | Koester | |
| 7,029,201 | B1 * | 4/2006 | McCormick et al. | 405/50 |
| 7,338,700 | B2 * | 3/2008 | McKenna et al. | 428/174 |
| D574,520 | S | 8/2008 | Taylor et al. | |
| D588,280 | S | 3/2009 | Gleeson | |
| D588,284 | S | 3/2009 | Gleeson | |
| D589,171 | S | 3/2009 | Gleeson | |
| D601,720 | S | 10/2009 | Gleeson | |
| D603,533 | S | 11/2009 | Gleeson | |
| D606,671 | S | 12/2009 | Southwell | |
| D606,672 | S | 12/2009 | Southwell | |
| D607,584 | S | 1/2010 | Ito | |
| D608,020 | S | 1/2010 | Gleeson | |
| 7,698,858 | B2 * | 4/2010 | Schroer et al. | 52/169.5 |
| 8,028,742 | B2 * | 10/2011 | Fiedrich | 165/56 |
| 8,046,956 | B1 * | 11/2011 | Hohmann, Jr. | 52/62 |
| 2002/0035809 | A1 | 3/2002 | Smythe, Jr. | |
| 2002/0073638 | A1 | 6/2002 | Kunz et al. | |
| 2003/0046888 | A1 * | 3/2003 | Ryan | 52/302.1 |
| 2003/0121224 | A1 * | 7/2003 | Lubker, II | 52/302.1 |
| 2003/0126810 | A1 | 7/2003 | Brunson et al. | |
| 2003/0230040 | A1 * | 12/2003 | Shirota | 52/302.1 |
| 2004/0020143 | A1 | 2/2004 | Webb | |
| 2004/0118076 | A1 | 6/2004 | Bezubic, Jr. | |
| 2004/0226238 | A1 | 11/2004 | Haapiainen | |
| 2006/0005489 | A1 | 1/2006 | Smythe, Jr. | |
| 2006/0005509 | A1 | 1/2006 | Yohnke et al. | |
| 2006/0010800 | A1 | 1/2006 | Bezubic, Jr. | |
| 2006/0080942 | A1 | 4/2006 | O'Neill | |
| 2006/0281889 | A1 * | 12/2006 | Kobayashi et al. | 528/34 |
| 2007/0130849 | A1 | 6/2007 | Langer et al. | |
| 2008/0216430 | A1 | 9/2008 | Gleeson et al. | |
| 2009/0019814 | A1 | 1/2009 | Gleeson et al. | |
| 2009/0064599 | A1 | 3/2009 | Bennett | |

FOREIGN PATENT DOCUMENTS

| | | | |
|---|---|---|---|
| AU | 99315 | | 1/1988 |
| AU | 105706 | | 10/1989 |
| AU | 109294 | | 10/1990 |
| AU | 112156 | | 9/1991 |
| AU | 112157 | | 9/1991 |
| AU | 122184 | | 12/1994 |
| AU | 124159 | | 7/1995 |
| AU | 128989 | | 1/1997 |
| AU | 745114 | | 12/1998 |
| AU | 136553 | | 3/1999 |
| AU | 143709 | | 5/2001 |
| AU | 783430 | | 6/2001 |
| AU | 735352 | | 7/2001 |
| AU | 2001287356 | | 4/2002 |
| AU | 148950 | | 8/2002 |
| AU | 2003204739 | B2 | 7/2003 |
| AU | 2003257906 | A1 | 7/2004 |
| AU | 310645 | | 10/2006 |
| CA | 974726 | | 9/1975 |
| CA | 2244625 | | 2/2000 |
| DE | 2440497 | | 3/1976 |
| EP | 0024360 | | 3/1981 |
| EP | 0074338 | | 3/1983 |
| EP | 0127824 | A2 | 12/1984 |
| EP | 0305209 | A1 | 3/1989 |
| EP | 0373017 | A1 | 6/1990 |
| EP | 0430667 | | 6/1991 |
| EP | 1243714 | A1 | 9/2002 |
| GB | 558239 | | 12/1943 |
| GB | 564447 | | 9/1944 |
| GB | 1086311 | | 10/1967 |
| GB | 1174902 | | 12/1969 |
| GB | 1590875 | | 6/1981 |
| GB | 2181470 | A * | 4/1987 |
| GB | 2378192 | | 2/2003 |
| JP | 06278116 | A | 10/1994 |
| JP | 07279275 | A | 10/1995 |
| JP | 08004248 | | 1/1996 |
| JP | 08068184 | A2 | 3/1996 |
| JP | 8109686 | | 4/1996 |
| JP | 8267624 | | 10/1996 |
| JP | 10280639 | | 10/1998 |
| JP | 11256683 | | 9/1999 |
| JP | 2000-1944 | | 1/2000 |
| JP | 2000-17751 | | 1/2000 |
| JP | 2000064554 | A2 | 2/2000 |
| JP | 2000336814 | A | 12/2000 |
| JP | 2001-227100 | | 8/2001 |
| JP | 2002161623 | A2 | 6/2002 |
| JP | 2003-239408 | A | 8/2003 |
| JP | 3733370 | B1 | 1/2006 |
| JP | 200716428 | | 1/2007 |
| NZ | 334899 | | 4/2000 |
| NZ | 335529 | | 12/2000 |
| NZ | 502017 | | 1/2001 |
| NZ | 525507 | | 9/2004 |

(56) References Cited

FOREIGN PATENT DOCUMENTS

| | | | |
|---|---|---|---|
| NZ | 536129 | | 2/2006 |
| TW | 278536 | | 6/1996 |
| TW | 278537 | | 6/1996 |
| TW | 282800 | | 8/1996 |
| WO | WO-8102758 | | 10/1981 |
| WO | WO-9324711 | | 12/1993 |
| WO | WO-9708111 | | 3/1997 |
| WO | WO-9964692 | | 12/1999 |
| WO | WO-02096824 | | 12/2002 |
| WO | WO-03035998 | A1 | 5/2003 |
| WO | WO-03089726 | A2 | 10/2003 |
| WO | WO-2004087412 | A1 | 10/2004 |
| WO | WO-2004092494 | A2 | 10/2004 |
| WO | WO-2005003478 | | 1/2005 |
| WO | WO-2005035900 | | 4/2005 |
| WO | WO-2005068741 | | 7/2005 |
| WO | WO-2005078210 | A1 | 8/2005 |
| WO | WO-2008113136 | A1 | 9/2008 |

OTHER PUBLICATIONS

Design U.S. Appl. No. 29/351,068 entitled "Building Element" filed Nov. 30, 2009; Inventor: D. Southwell.
Simplicity Tool Corporation, Off Stud Joiners (May 12, 2009), 1 pg.
Simplicity Tool Corporation, Installation Instruction for Off Stud Joiners (May 12, 2009), 1 pg.
CertainTeed, WeatherBoards™ Fiber Cement Siding: Lap Siding Installation Guide (Oct. 2008), 8 pp.
BGC Fibre Cement, Duraplank™ Technical Information (Apr. 2007), 12 pp.
James Hardie, External Cladding: Technical Specification (Sep. 2005), 32 pp.
Scyon™ Stria™ Cladding, Installation Instructions (Jun. 2008), 6 pp.
Scyon™ Matrix™ web pages printed Sep. 13, 2006, at http://www.jameshardie.com.au/Products/Scyon/Cladding/Matrix/default.htm, 3 pp.
Scyon™ Axon™ web pages printed Sep. 13, 2006, at http://www.jameshardie.com.au/Products/Scyon/Cladding/Axon, 3 pp.
Scyon™ Linea™ web pages printed Sep. 13, 2006, at http://www.jameshardie.com.au/Products/Scyon/Cladding/Linea/default.htm, 3 pp.
International Appl. No. PCT/AU2007/000096, International Search Report, mailed Mar. 29, 2007, 2 pp.
Department of Building and Housing, New Zealand Building Code Acceptable Solution E2/AS1: Roof Cladding (Jul. 1, 2005), 37 pp.
Decision of Appeal for Taiwan Patent Appl. No. 85114421 (with translation), dated Feb. 24, 1999, 7 pp.
Decision of Opposition for Taiwan patent Appl. No. 85114421 (with translation), dated Aug. 3, 1998, 7 pp.
ETERNIT, "Glasal Fibre Cement Cladding Panels" (May 2003), 8 pp.
ETERNIT, "Omega and Zeds" (May 2003), 8 pp.
Design U.S. Appl. No. 29/324,751 entitled "Moisture Barrier" filed Sep. 19, 2008; Inventor: James Gleeson.
Design U.S. Appl. No. 29/324,748 entitled "Moisture Barrier" filed Sep. 19, 2008; Inventor: James Gleeson.

* cited by examiner

FRAMED WALL CONSTRUCTION AND METHOD

FIELD OF THE INVENTION

The present invention relates generally to wall construction, and in preferred forms relates to framed wall construction.

DESCRIPTION OF THE PRIOR ART

The following discussion of the prior art and any other prior art references throughout the specification are intended to provide an appropriate technical context for the invention and to enable the advantages of it to be more fully understood. Any such references, however, should not be construed as an express or implied admission that such art was well known or formed part of common general knowledge in the field at the priority date.

The invention has been developed primarily for use in conjunction with timber framing and fiber reinforced concrete (FRC) cladding materials, in the context of housing construction. It will be appreciated, however, that the invention is not limited to this particular combination of materials or this particular form of building construction.

In housing and other forms of building, it is a common construction technique to form a frame from timber, steel or other suitable materials, and optionally to affix a generally planar structural layer, typically formed from a series of structural panels, to the frame to provide structural rigidity. The structural panels are usually formed from timber, timber composites such as plywood or oriented strand board (OSB), or other suitable materials. A cladding material formed from FRC sheet, weatherboard, masonry, or other suitable material is then affixed to the structural member and/or the frame to provide exterior weather protection and desired aesthetic characteristics. The interior of the building is then usually lined with plasterboard, gypsum board, or other suitable materials to complete the wall construction.

The frame typically comprises a series of spaced apart vertically extending framing elements, known as studs, and a series of spaced apart framing elements extending generally horizontally between the studs, known as noggins. Other framing members such as top plates, bottom plates and diagonals are also typically used, as is well known and understood by those skilled in the art.

In climatic regions prone to sustained or heavy rainfall or high humidity, it is common for moisture to permeate through or around the external cladding, and onto the underlying frame. Once this moisture permeation has occurred, it can be difficult to dry the wall structure, which results in numerous problems including rotting of structural and framing members, moisture damage to internal lining or external cladding materials, accelerated corrosion of metal fasteners, peeling of paint on internal and external surfaces, propagation of mould, rising damp, and the like.

It is known that these problems can be minimized by improved drainage and ventilation of the area behind the cladding. One known method of achieving this is to secure a series of timber battens onto the outer faces of the studs and noggins during construction. The external cladding sheets are then fixed to, or through, the timber battens, usually by nailing or screwing. Importantly, the battens are not coextensive with the outer surfaces of the framing members, but rather are cut short. The resultant gaps allow migration of moisture, as both liquid and vapor, within the wall, around the battens, in a plane immediately behind the external cladding sheets and immediately in front of the outer faces of the structural framing members. While the precise mechanics behind these water transport and evaporation processes are not necessarily fully understood, it is known empirically that this arrangement does in fact facilitate evaporation and/or dispersion of retained moisture, and consequential drying of the wall cavities and framing members. However, it has been found in practice that the timber battens themselves are prone to moisture absorption. This is not a useful characteristic in a system specifically intended to facilitate moisture dissipation, and inevitably impedes the drying process.

A further problem relates to corrosion of metal fasteners. The usual method of treatment for timber battens exposed to moisture for prolonged periods involves the use of an acidic solution of copper, chromium and arsenate (CCA), which is designed to fully penetrate the timber under external pressure. If timber treated in this way remains wet for prolonged periods, as is typically the case in the present context, standard galvanized nails or screws become corroded to an unsatisfactory degree. In order to ameliorate this problem, it is possible to use stainless steel nails. However, this adds significantly to the cost of materials. Furthermore, stainless steel nails are often not available in collated magazine form for use in nail guns. Consequently, in such situations, the builder must nail the cladding sheets to the battens by hand. This is time-consuming, inconvenient, and adds significantly to the labour as well as the material cost.

Damage due to moisture permutation through or around the external cladding can also be somewhat reduced by the provision of waterproof flexible membrane such as housewrap, sarking or building paper, installed behind the cladding material. Entry of water, particularly wind-driven rain, into buildings can still be a problem, however, when such systems are used in high wind areas or on the upper stories of low to medium rise buildings. This is because housewraps, sarking materials and the like are flexible and are prone to deform when exposed to wind or more generally when a pressure differential exists on opposite sides of the structural member. This in turn can allow rain or liquid water to enter the wall cavity, particularly where adjacent sheets of sarking join or overlap, and become trapped. The waterproofing capacity of conventional housewrap materials is also compromised when the wrap is punctured, for example by fasteners.

Moreover, as many of these wraps do not provide an exit path for moisture that does migrate into the wall cavities, they can actually exacerbate the problem by reducing the opportunity for the cavities to dry out and by maintaining moisture in direct contact with framing elements or other structural members. This gives rise to similar problems to those outlined above.

It is an object of the present invention to overcome or ameliorate one or more of the disadvantages of the prior art, or at least to provide a useful alternative.

SUMMARY OF THE INVENTION

Accordingly, in one or more embodiments is provided a drainage panel for a framed wall construction comprising:

- a substantially water-resistant front surface; and
- a plurality of spaced apart drainage channels disposed on said surface to facilitate drainage of water between said drainage panal and a cladding material affixed to said front surface;
- wherein said front surface is at least partially permeable to air and water vapor while being substantially impermeable to water in it is liquid form.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

According to another embodiment, provided herein is a membrane for a framed wall construction of the kind optionally having one or more spaced vertical frame elements, said membrane comprising:

a substantially water-resistant front surface;

a plurality of spaced apart drainage channels disposed on said front surface to facilitate drainage of water between said drainage panal and a cladding material affixed to said front surface; and indicia for substantially indicating the position of at least one of said frame elements such that fasting locations are provided.

According to still another embodiment, described herein is a framed wall construction comprising a generally vertically orientated frame;

a substantially planar layer of the drainage panel as described herein and /or in according with any one of the relevant claims that may be fixedly attached to and substantially covering the frame; and a cladding material substantially covering said drainage panel.

In yet a further embodiment, described herein and is a framed wall construction comprising:

a generally vertically orientated frame;

a substantially planar layer of a membrane as described herein and/or in accordance with any one of the embodiments and/or relevant claims fixedly attached to and substantially covering the frame; and a cladding material substantially covering the membrane.

Still further described herein is a framed wall construction as described herein comprising:

a generally vertically oriented frame;

a substantially planar layer of a structural material fixedly attached to and substantially covering said frame a planar layer of a membrane as described herein and/or in accordance with any one of the claims fixedly attached to and substantially covering the structural material; and a cladding material substantially covering the membrane.

Additionally described herein is a method of forming a framed wall construction, said method comprising the steps of:

forming a generally vertically orientated frame;

attaching a planar layer of the drainage panel as described herein and/or in accordance with any one of the claims, so as to cover said frame; and securing a cladding material so as substantially to cover a front surface of said drainage panel.

Still further is provided a method of forming a framed wall construction, said method comprising the steps of:

forming a generally vertically orientated frame;

attaching a substantially planar layer of structural material so as to substantially cover said frame;

attaching a planar layer of the membrane as described herein and/or in accordance with any one of the claims so as substantially to cover said structural material; and securing a cladding material so as substantially to cover a front surface of said membrane.

Even further embodiments provided herein include a method of forming a framed wall construction, said method comprising the steps of:

forming a generally vertically orientated frame;

attaching a planar layer of the membrane as described herein and/or in accordance with any one of the claims so as substantially to cover said frame; and securing a cladding material so as substantially to cover a front surface of said membrane.

In one or more embodiments, the drainage panel or membrane further comprises a plurality of spaced apart secondary drainage channels disposed on the front surface, the secondary drainage channels extending generally transversely to the primary drainage channels and intersecting with at least some adjacent pairs thereof, the drainage channels being adapted to facilitate drainage of water between the drainage panel or membrane and the cladding material. The secondary drainage channels may obliquely extend between at least some adjacent pairs of the primary drainage channels. However, it should be understood that the secondary drainage channels may be straight, curved, or disposed in any other geometrical arrangement.

In one embodiment, the secondary drainage channels are adapted to direct water between the primary drainage channels and may provide cross ventilation between at least some adjacent pairs of the primary drainage channels.

In some embodiments, the primary drainage channels are configured in use, to extend substantially vertically along the drainage panel or membrane.

In one or more additional embodiment, the primary and secondary drainage channels combine to define an array of relatively raised and substantially planar lands with respect to the drainage channels. The array of lands is preferably in the form of a series of horizontal rows and vertical columns. In one embodiment the framed wall construction includes one or more vertical framing elements and wherein at least one of the vertical column of lands is adapted to substantially align with at least one vertical frame element during assembly of the wall construction. The drainage panel or membrane may include one or more columns of relatively larger lands adapted to substantially corresponding to the vertical framing elements. The vertical framing elements may be spaced at intervals of 12, 16 or 24 inches (305, 405 or 610 millimeters).

In one embodiment the front surface includes indicia to indicate fastening locations. Preferably, the indicia includes longitudinally extending grooves disposed on at least some of the vertical column of lands. Alternatively, the indicia includes centerlines disposed on the front surface. Preferably, two or more of the secondary drainage channels are spaced in relative close proximity thereby to further indicate fastening locations.

In one or more embodiments, drainage panel or membrane includes a plurality of spaced apart longitudinally extending supporting protrusions disposed on the rear surface of the drainage panel or membrane, the protrusions being substantially complementary to the longitudinally extending grooves.

In one or more embodiments, the width of each primary drainage channel is adapted to allow an adhesive sealing tape to closely follow the surface profile of the front surface to provide a seal that prevents, or at least minimizes, moisture penetrating along the adhesive tape line. The drainage panel or membrane may include a chamfered portions disposed between at least some of the drainage channels and the lands, the chamfered portions being adapted to assist the adhesive sealing tape to more closely follow the front surface of the drainage panel or membrane.

In one or more embodiments, the primary and secondary channels are roll-formed into the drainage panel or membrane. Alternatively, the primary and secondary channels are embossed, cast or machined into the drainage panel or membrane. Other manufacturing techniques including fabrication and extrusion may also be used in some embodiments.

In one or more embodiments, the drainage panel or membrane includes a water-resistant front surface having selective permeability characteristics, in the sense of being at least partially permeable by air and water vapor (i.e. breathable), while being substantially impermeable by water in liquid form. The water-resistant front surface may be both breathable and substantially hydrophobic.

In one or more embodiments, the drainage panel or membrane is substantially formed from a polymeric or substantially water repellent cellulosic material, perforated polymer film, spunbonded polymer sheet or a combination thereof.

In another embodiment, the moisture barrier is substantially formed from wood, wood composite, OSB, plastics, other composite barriers, fiber reinforced cement or a combination thereof. Preferably, the moisture barrier is substantially formed from fiber-reinforced cement.

In one embodiment, the moisture barrier includes a hydrophobic film or coating of substantially water repellent cellulosic material, perforated polymer film, spunbonded polymer sheet or a combination thereof. Preferably, the hydrophobic coating includes siloxane. It will be appreciated, however, that other suitable coatings, layers, films or surface treatments may additionally or alternatively be used. In some embodiments, both the front and back surfaces, and optionally the edges, are coated.

In one embodiment, the moisture barrier is in the form of one or more drainage panels. Each drainage panel is preferably sealed along peripheral edges by a sealing means such as an adhesive sealing tape. Preferably, each drainage panel is substantially rectangular in shape, having top, bottom and side edges.

In one embodiment, each primary and secondary drainage channel is approximately ⅛" (3.2 mm) deep. Preferably, the secondary drainage channels have a width generally tapering from 9/16" (14.3 mm) to 5/16" (8.0 mm). More preferably, the horizontal rows of lands are generally evenly spaced. More preferably, the distance between each adjacent pair of horizontal rows of lands is approximately 2" (50 mm).

In one embodiment, the maximum depth of each primary and secondary drainage channel is approximately 3/32" (2.5 mm). Preferably, the primary and secondary channels have a width of approximately ⅕" (5 mm).

In yet a further embodiment, the maximum depth of the primary and secondary drainage channels is approximately 2/32" (1.5 mm). Preferably, the lands are substantially round. In this embodiment, the primary and secondary drainage channels have a width of approximately 4/5" (20 mm).

It will be appreciated, that the width, depth, length, shape and spacing of the channels may be varied to suit particular materials, construction techniques, building applications and environmental conditions.

In one embodiment, the cladding material is in the form of at least one cladding panel including a cementitous barrier, oriented strandboard, plywood, metal, masonry or a combination of these. Preferably, the cladding material includes at least one cladding panel substantially formed from fibre-reinforced cement.

BRIEF DESCRIPTION OF THE DRAWINGS

Preferred embodiments of the invention will now be described, by way of example only, with reference to the accompanying drawings in which.

PREFERRED EMBODIMENTS OF THE INVENTION

Figure 1:
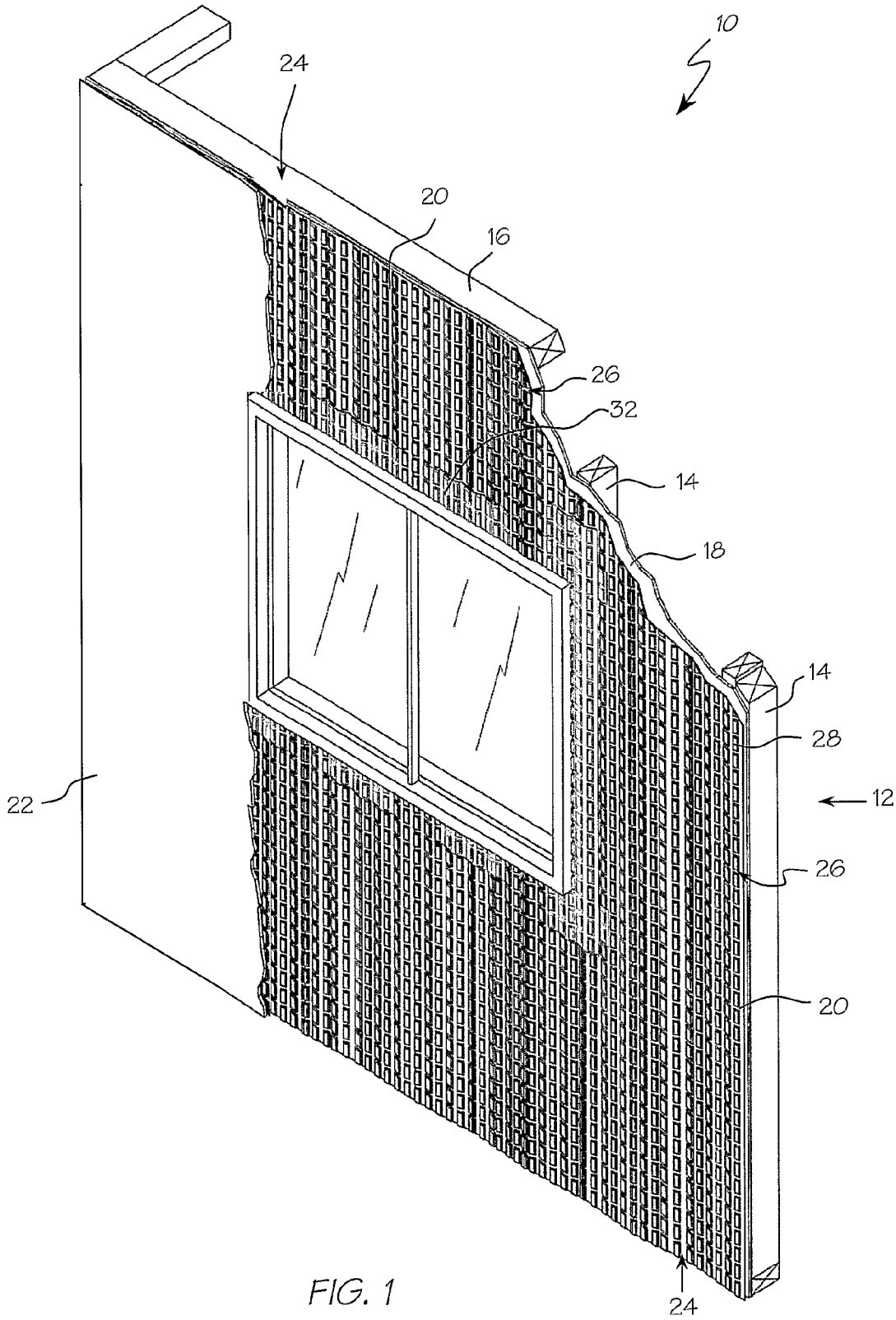
FIG. 1 is a partly cut-away perspective view of a framed wall construction in accordance with one embodiment of the invention.
Figure 2:
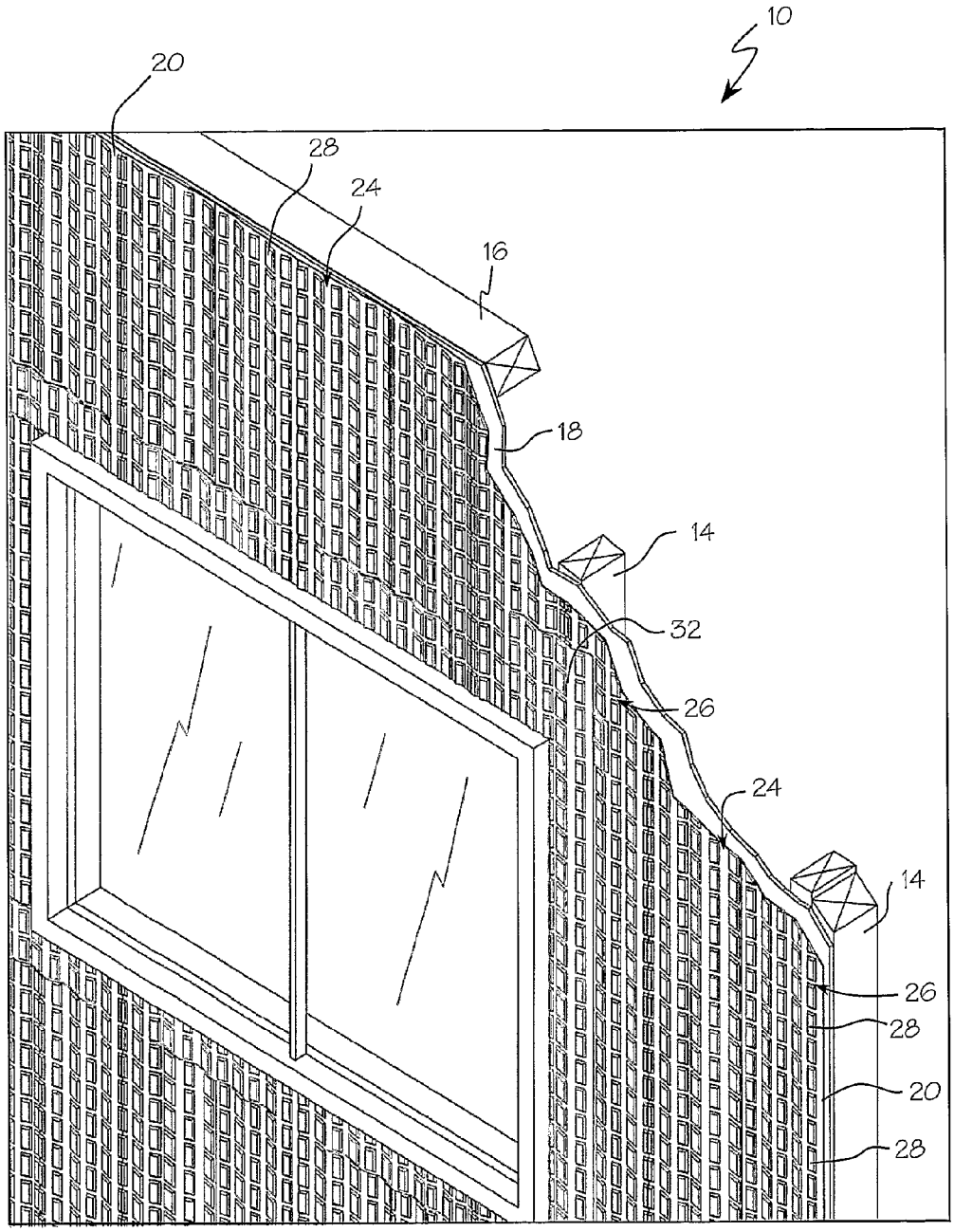
FIG. 2 is an enlarged perspective view of the framed wall construction of FIG. 1.
Figure 3:
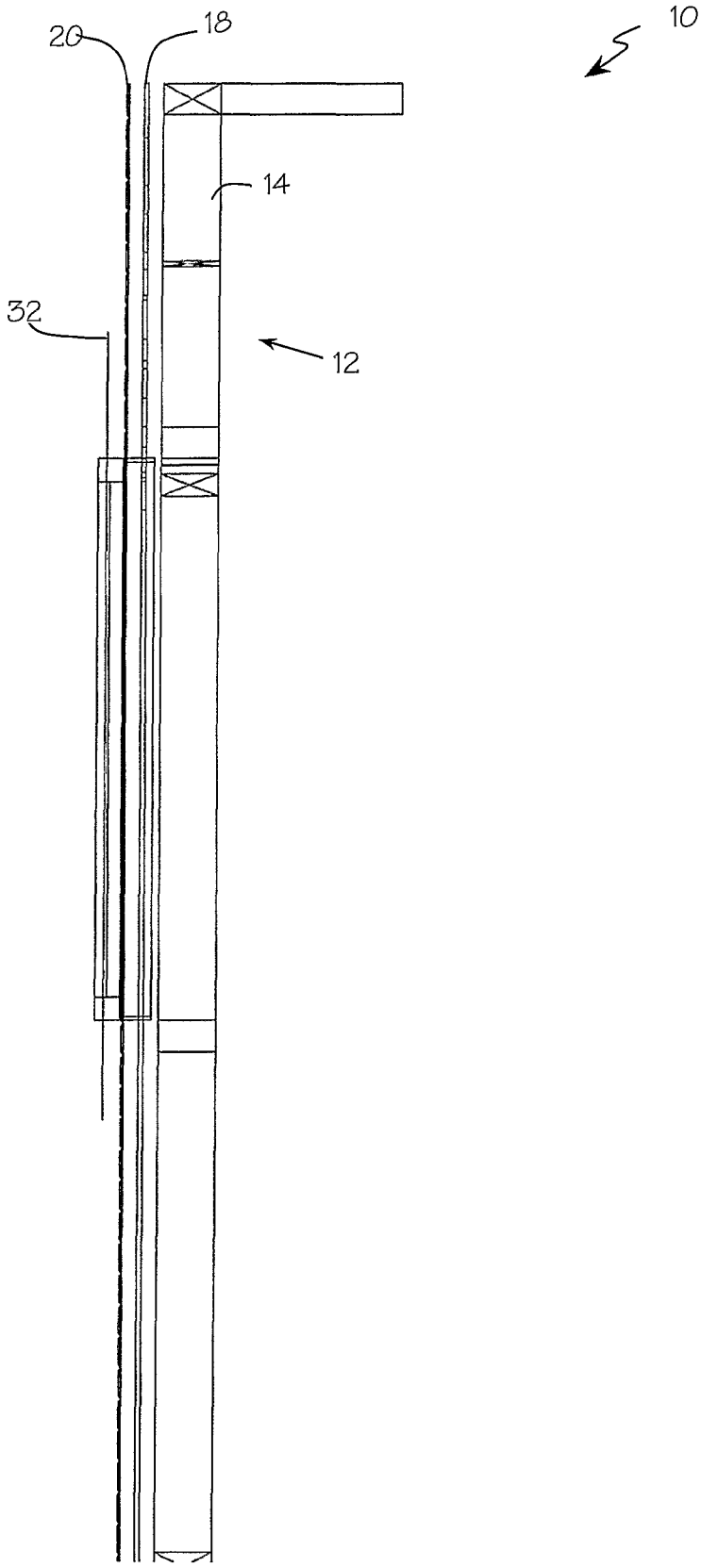
FIG. 3 is an exploded view of the framed wall construction of FIG. 1.

Referring initially to FIGS. 1 to 3, there is provided a framed wall construction 10 typically used in housing or other types of building construction.

The framed wall construction comprises a generally vertically orientated frame 12 including a series of spaced apart vertical framing elements, commonly known as studs 14, and a series of spaced apart horizontal framing elements, commonly known as noggins 16. In this example, the framing elements are formed from timber but those skilled in the art will appreciate that other framing materials such as steel or composite materials may alternatively be used.

A planar layer of structural material in the form of one or more structural panel members 18, is fixedly attached to the frame 12 so as to substantially cover the frame and provide structural rigidity. The structural panels may be formed from any suitable material such as wood, wood composite (such as oriented strandboard or plywood), or plastics materials, but are preferably formed from fibre-reinforced cement (FRC). The structural panels 18 are secured to the frame by nailing, screwing, gluing or by other suitable fastening means. Moreover, the number of structural panels may vary depending upon the overall dimensions of each panel and the area of the frame to be covered.

A moisture barrier in the form of a flexible membrane 20 having a water-resistant front surface is attached to the structural panels 18, again by nailing or other suitable fastening means such as an adhesive means, so as to completely cover the outer surface of the structural panels. In the illustrated embodiment, the membrane has selective permeability characteristics, in the sense of being at least partially permeable to air and water vapour (ie "breathable"), while being substantially impermeable to water in liquid form. In this respect, it will be appreciated that the membrane 20 may be formed from any suitable hydrophobic material such as, but not limited to, porous polymer film or spunbonded polymer sheet. Woven fabrics formed from suitable polymeric materials, with appropriate surface treatments if required, may also be used. In another variation, the membrane may be formed from a flexible non-hydrophobic material, incorporating a hydrophobic surface treatment or film.

To complete the wall construction, an outer cladding material 22 is secured so as to substantially cover the front surface of the membrane and underlying structural layer. Ideally, any nailing or screwing of the cladding material 22 will pass through the membrane 20 and structural panel members 18 into either the studs 14 or noggins 16.

In accordance with the illustrated preferred embodiment, the membrane 20 includes a plurality of spaced apart primary drainage channels 24 disposed on its front surface. In addition, a plurality of spaced apart secondary drainage channels 26, preferably extending generally obliquely between adjacent pairs of the primary drainage channels 24, are also disposed on the membrane's front surface. However, it should be understood that the secondary drainage channels may be straight, curved, or disposed in any other geometrical arrangement as, for example, shown in other embodiments. The primary and secondary drainage channels are open-ended, thereby promoting moisture egress and allowing for fluid transfer between interconnecting channels.

As can be seen, the drainage channels intersect and combine to define an array of raised areas or lands 28 disposed in rows and columns somewhat reminiscent of a tire tread pattern. The arrangement is such that the primary and secondary drainage channels collectively provide a dense network of drainage paths for any moisture in liquid form that becomes trapped between the water-resistant membrane 20 and the overlying cladding material 22, to facilitate rapid drainage of any such moisture from the wall structure. The interconnecting drainage paths also facilitate cross-ventilation between the membrane and the cladding material, to assist in the removal of water vapor and hence promoting rapid drying within the wall structure.

Figure 7:
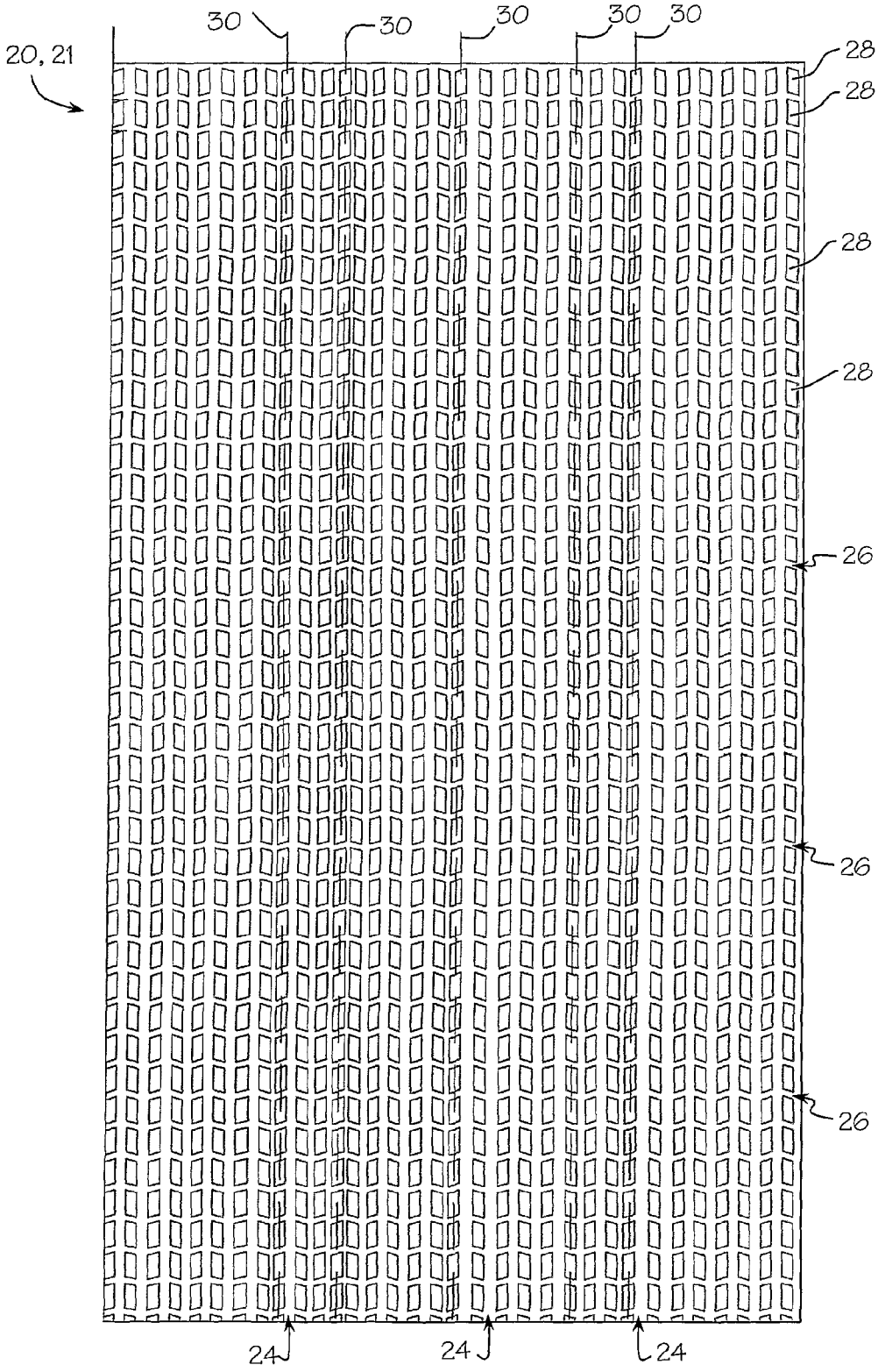
FIG. 7 is a plan view of the membrane or drainage panel for the framed wall constructions of FIGS. 1 and 4.

The spacing of the primary drainage channels 24 is designed such that in use, at least one column of lands 28 coincides with each of the studs 14. In this way, planar surfaces, corresponding to the tops of the lands, are always advantageously available to facilitate nailing or screwing of the membrane to each stud, through the intermediate structural layer. For this reason and as best shown in FIG. 7, indicia is provided on the membrane surface in the form of printed or embossed centerlines 30 or other forms, which correspond to standard 12, 16 and 24" (305, 405 or 610 mm) stud spacing.

It should also be noted that at each stud position, the columns of lands 28 are positioned marginally closer together, so that in use, the resultant periodic disruption to the otherwise regular pattern of land columns provides a further, or optionally an alternative visual indication of the underlying stud spacing, as well as providing a greater density of raised lands, to facilitate nailing. Consequently, in this embodiment the widths of the primary drainage channels 24 may vary to suit the application.

In this preferred form, the depth of the primary drainage channels ideally remains generally constant at approximately ⅛" (3 mm). The secondary drainage channels 26 similarly have the depth of approximately ⅛" (3 mm), with a substantially constant width of approximately 9⁄16" (14 mm) at the top, tapering to a width of approximately 5⁄16" (8 mm) at the bottom. However, it will be appreciated that these dimensional parameters may be varied to suit particular materials, construction techniques, environmental conditions and other relevant design criteria.

As described above, there is a greater density of lands along the stud locations to facilitate nailing. Accordingly, fasteners are more likely to pass through the lands rather through the drainage channels. Therefore, the primary and secondary drainage channels advantageously remain intact to a greater degree providing fewer opportunities for liquid water to pass beyond the membrane and onto the framing or structural material directly. In addition, by placing fasteners through the raised lands, the increased thickness provided assists in sealing to further inhibit liquid ingress beyond the membrane.

The provision of raised lands essentially defines two planar surfaces once the membrane is installed: a drainage surface defined by the bottom of the drainage channels, and an upper land area second plane defined by the upper surface of the lands. It can therefore been seen that the amount of land area can be varied depending on the selected application. For example, if the cladding material is of brittle construction then a larger land/smaller drainage area should be provided such to minimize the possibility of the cladding material fracturing or cracking due to falling into the drainage channels during installation. In the same vein, if the cladding is formed from a more flexible material, a smaller drainage surface area is preferably provided to minimize possible unsightly deformation. Alternatively, if the cladding material is more resilient and therefore more resistant to the deformation, a relatively larger drainage surface area is allowed.

It is proposed that the membrane 20 be supplied in roll form in standard heights and lengths. To install, it is simply rolled out over the structural panels 18 such that the centerlines 30 (or other form of indicia) align with the respective studs 14. Nailing or screwing of the membrane to the frame and structural members can then take place. Once the membrane is fixed in place, any cut outs or other shaping is done to accommodate windows or doors. Subsequent to this, any joins are sealed using an adhesive sealing tape 32. In this regard, the planar profile of the lands 28 and the generous width of the primary and secondary channels advantageously allow the sealing tape 32 to closely follow the surface profile of the membrane, thereby providing a seal that prevents, or at least minimizes, moisture penetration along the adhesive tape line.

It will be appreciated that the illustrated membrane 20 provides a means to drain any moisture that is trapped between the membrane and the cladding material 22 due, for example, to wind driven rain. Under these circumstances, any trapped moisture will simply flow downwardly through the channels to exit along the lower edge of the wall structure, optionally through dedicated gutters, pipes or drainage channels.

Furthermore, the generally hydrophobic properties of the membrane 20 assist the flow of water along the channels, as well as resisting moisture transfer to the underlying structural panels and framing members of the wall. In this way, any welling of water within the structure is eliminated or substantially reduced and the associated risk of rotting of wall components is also substantially reduced. As previously noted, the primary and secondary channels also cooperate to improve ventilation behind the cladding material, thereby accelerating the drying process in the event of water ingress and further reducing any possibility of water welling.

In some applications the structural panel members 18 are omitted from the framed wall construction 10. Under these circumstances, the membrane 20 is fixed directly to the frame 12 and the cladding material 22 is secured so as to substantially cover the front surface of the membrane. In one form, the cladding material is nailed or screwed to the frame, with the fasteners passing through the membrane. The cladding material may, depending upon its composition, act to supplement the structural rigidity of the wall construction. Otherwise, the frame is designed with sufficient structural integrity so as to obviate the need for structural augmentation from the structural or cladding layers.

Figure 4:
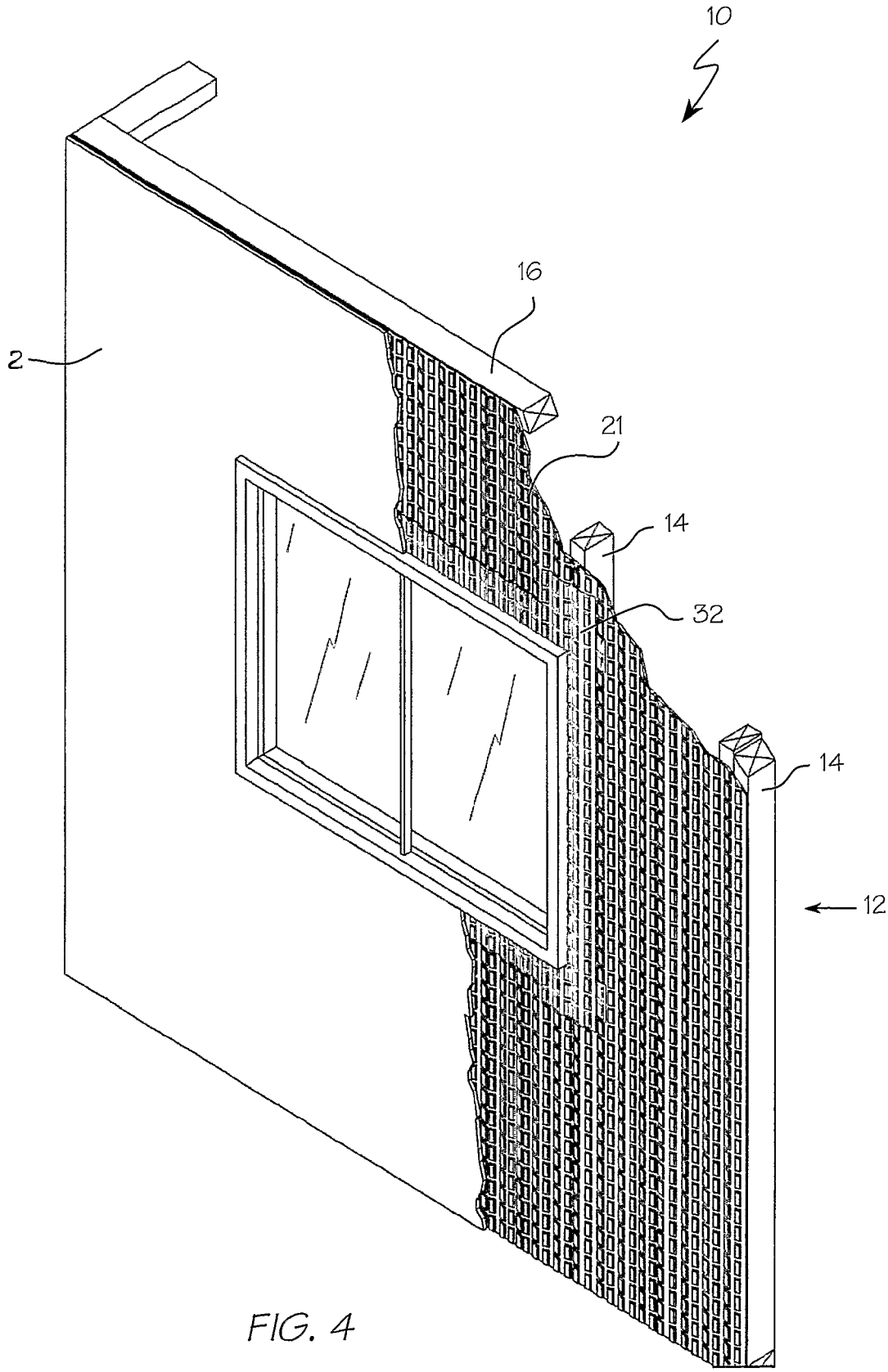
FIG. 4 is a partly cut-away perspective view of a framed wall construction in accordance with a second embodiment of the invention.
Figure 5:
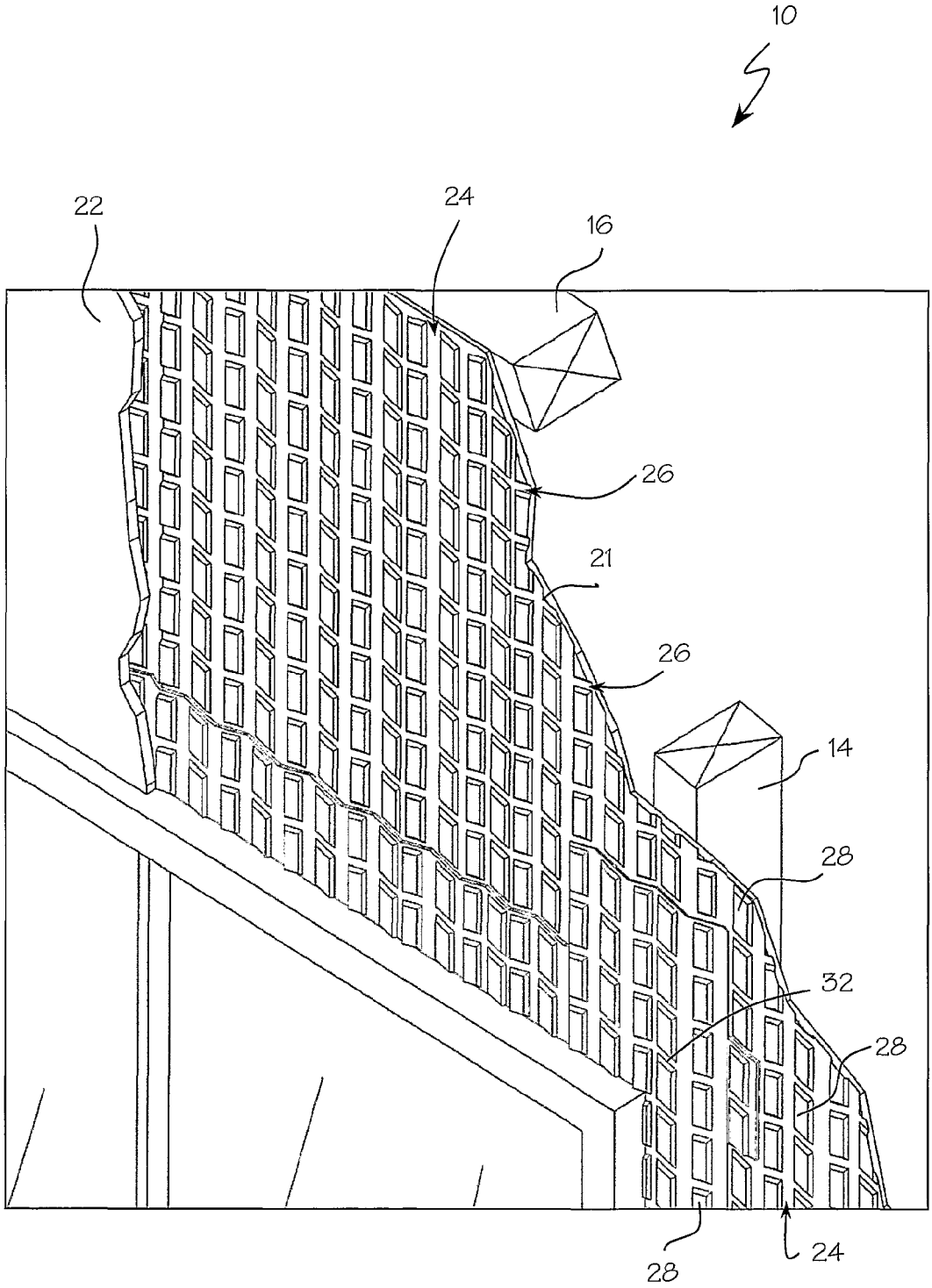
FIG. 5 is enlarged perspective view of the framed wall construction of FIG. 4.
Figure 6:
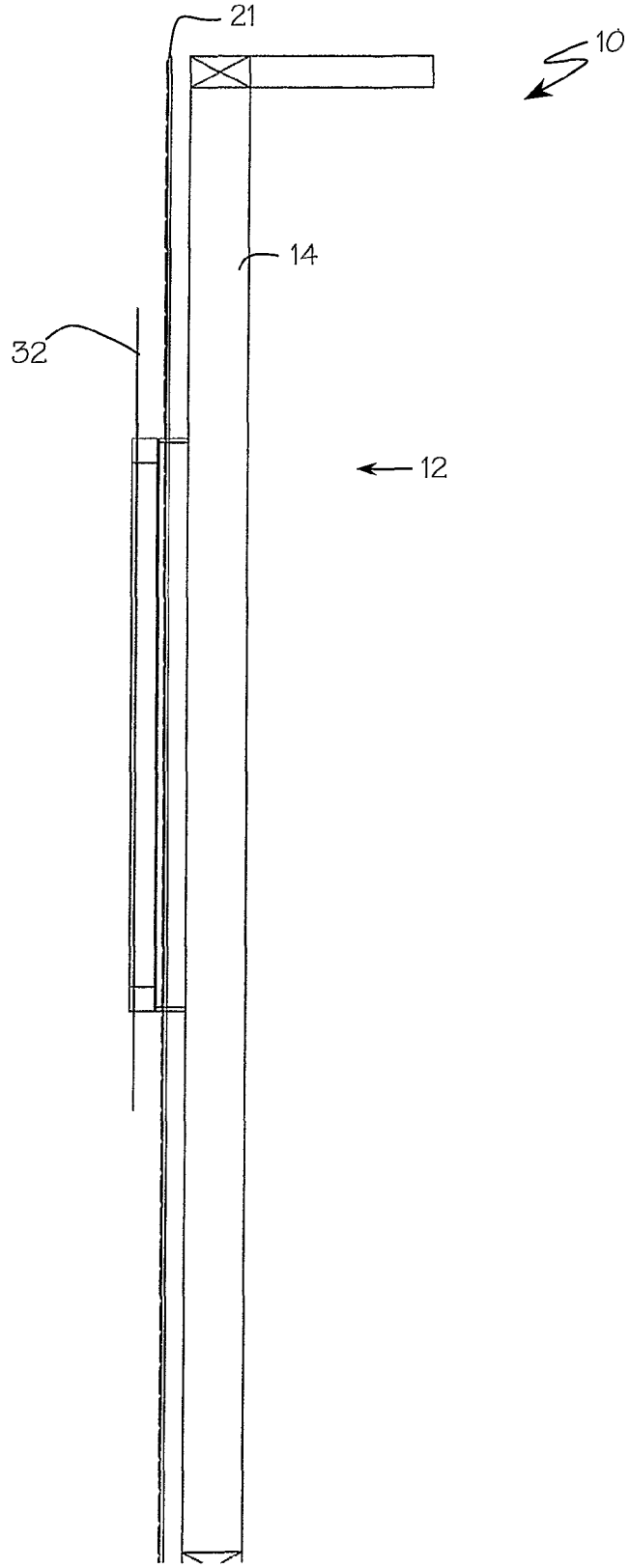
FIG. 6 is a partly exploded sectional view of the framed wall construction of FIG. 4.

Referring now to FIGS. 4 to 6, there is depicted a preferred form of a second embodiment of the framed wall construction 10. This embodiment differs from the first embodiment in that membrane 20 and structural panel 18, as separate and discrete components have been omitted. In their place there is a substantially rigid drainage panels 21, which include a water-resistant or hydrophobic front surface. The respective primary and secondary drainage channels 24, 26 are again recessed into the front faces of the drainage panels to similarly define the intermediate lands 28. Thus, the primary and secondary drainage channels provide drainage paths for any water trapped between the drainage panel and the cladding 22.

The drainage panel 21 is preferably formed from fiber reinforced cement ("FRC") sheet material incorporating a hydrophobic film, coating or treatment on the front surface thereof Of course, other suitable materials may be used including, but not limited to, wood, plastics, sheet metals, fiberglass or other composite materials, or combinations thereof. Moreover, as mentioned earlier with reference to the membrane, the drainage panel has selective permeability characteristics, in the sense of being at least partially permeable by air and water vapor (i.e. "breathable"), while being substantially impermeable by water in liquid form. In this regard, the water-resistant front surface of the drainage panel 21 is ideally is both breathable and substantially hydrophobic.

The coating or films used may include water repellent cellulosic material, perforated polymer film, spunbonded polymer sheet or a combination thereof In the illustrated embodiment it is most likely to include a siloxane material. It will be appreciated, however, that other suitable coatings, layers, films or surface treatments may additionally or alternatively be used. In some applications, both the front and back surfaces, and optionally the edges, are coated.

The general layout of the lands 28 is substantially identical to the layout of the lands of the membrane 20. Consequently, and as best illustrated by reference to FIG. 7, there is provided a similar pattern of column spacings to facilitate alignment with the studs 14 of the frame 12, as well as indicia in the form of centerlines 30 indicating the positions of the studs, to provide nailing or screwing locations.

Moreover, each panel or sheet is sized to substantially coincide with standard frame heights or standardized proportions thereof and, as mentioned earlier, predetermined stud locations.

The primary and secondary channels may be formed in the drainage panels 21 by profile rolling, embossing, milling, machining, casting, extruding, wet laying, spraying or some combination of one or more of these processes. Similarly, the primary and secondary channels may be formed using other methods including fabrication.

To install, the drainage panels 21 are fixed into place using nails, screw fasteners or other suitable means, in end-to-end or side-by-side abutment so as to substantially cover the exposed surface of the frame 12. Any required cutouts or other shaping operations are then performed to provide access for windows, doors or other fittings. Subsequent to this, the joins are sealed using an adhesive sealing tape 32 or other sealing means. The cladding material is then secured in place in a similar way to the first embodiment to complete the construction, noting that in this case a separate membrane installation step is not required. Also, as with the first embodiment, the widths of the primary and secondary drainage channels may vary to provide sufficient support for the type of cladding material used.

Again, in a similar way to the membrane of the first embodiment, the drainage panels may act to replace the structural panels 18, or alternatively may be installed over the structural panels 18. In the either case, the overall thickness of the drainage panel may vary depending on the structural properties required.

Figure 8:
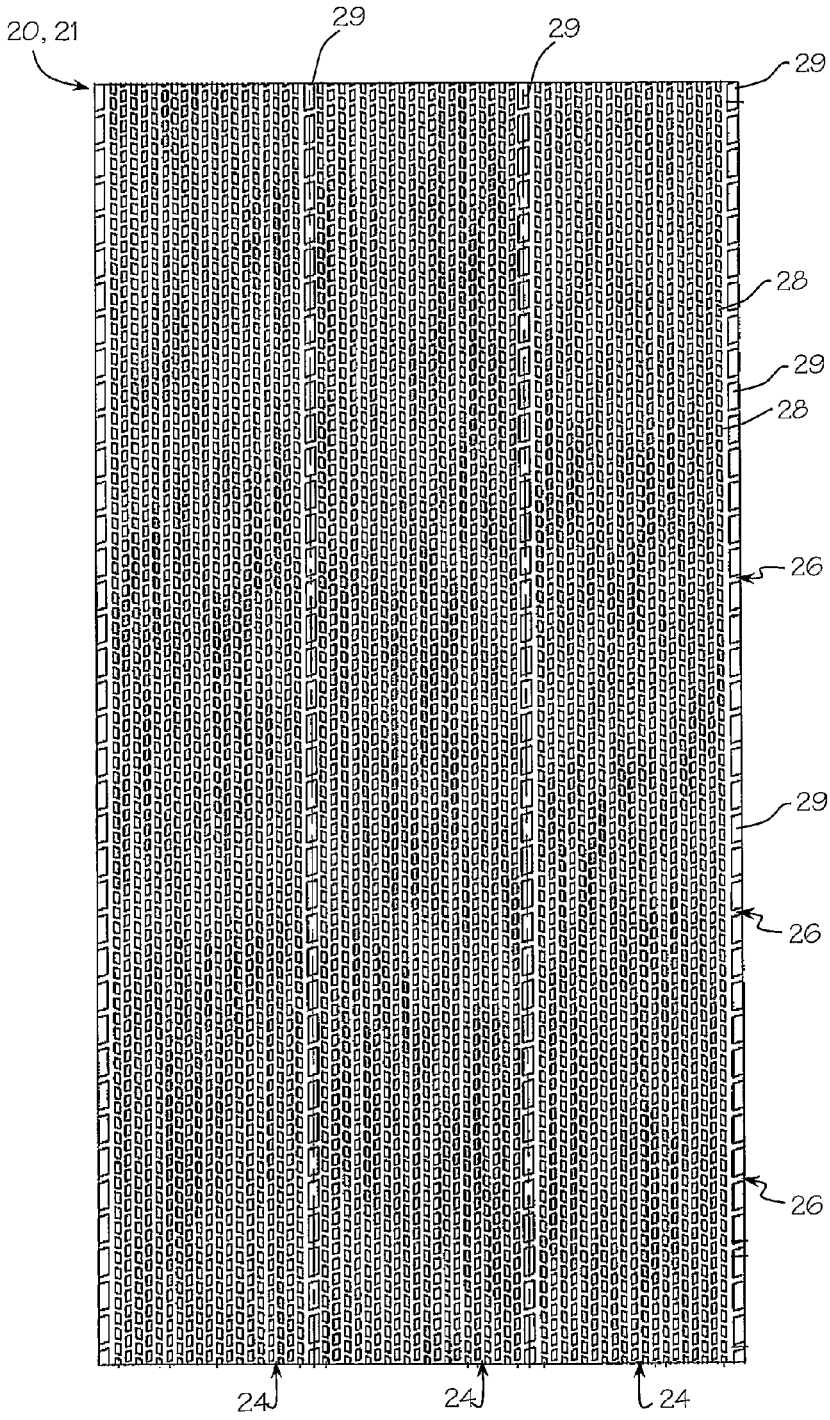
FIG. 8 is a plan view of a membrane or drainage panel for a framed wall construction, in accordance with a further embodiment of the invention.

A variation of the first and second embodiments is shown in FIG. 8. In a preferred form of this embodiment, the membrane 20 or drainage panels 21 are similar to the first and second embodiments, differing primarily in the pattern of the array of lands 28. In this respect, the lands of the present embodiment are now regularly staggered, with the primary drainage channels defined as before, however, the secondary drainage channels 26 now generally zigzag across the front surface.

This staggered pattern favorably eliminates the continuous horizontal path of the secondary drainage channels 26 and provides a more regular support surface, thereby reducing the likelihood of an edge of the cladding material fracturing by falling into the drainage channels during installation. It has been found that this alternate form is particularly advantageous when the cladding material is in the form of individual abutting plank portions formed from brittle materials such as fiber cement.

Also, rather than relying on condensed land spacing or external indicia to indicate the location of the studs, this alternate form preferably includes vertical columns of larger lands 29, the locations of which, correspond to standard stud locations on the frame. In this respect, the larger lands not only indicate the stud locations, they also beneficially provide a larger area for nailing and/or screwing of fasteners into the stud.

Figure 8A:
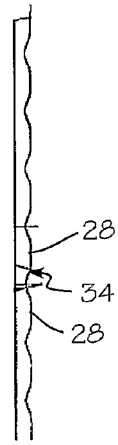
FIG. 8*a* is a section view of the membrane or drainage panel of FIG. 8.

Referring now to FIG. 8*a,* there is depicted a cross sectional view of this embodiment. It can be seen that transitional chamfered portions 34 are also provided between each land 28 and respective drainage channel. As a result, the drainage channels now have partly arcuate cross sectional profile, which in turn, provides a substantially edgeless surface between each land. In this way, the adhesive sealing tape 32 is able to more closely follow the surface profile and better adhere to the membrane or panel member surface to maintain a better seal and longer life for the framed wall construction 10. In a further variation of this alternate form, the chamfered portions 34 substantially follow a sinusoidal path.

In this embodiment, the maximum depth of the primary and secondary drainage channels 24, 26 preferably remain generally constant at approximately 3/32" (2.5 mm), and have a substantially constant projected width of 1/5" (5 mm).

Figure 9:
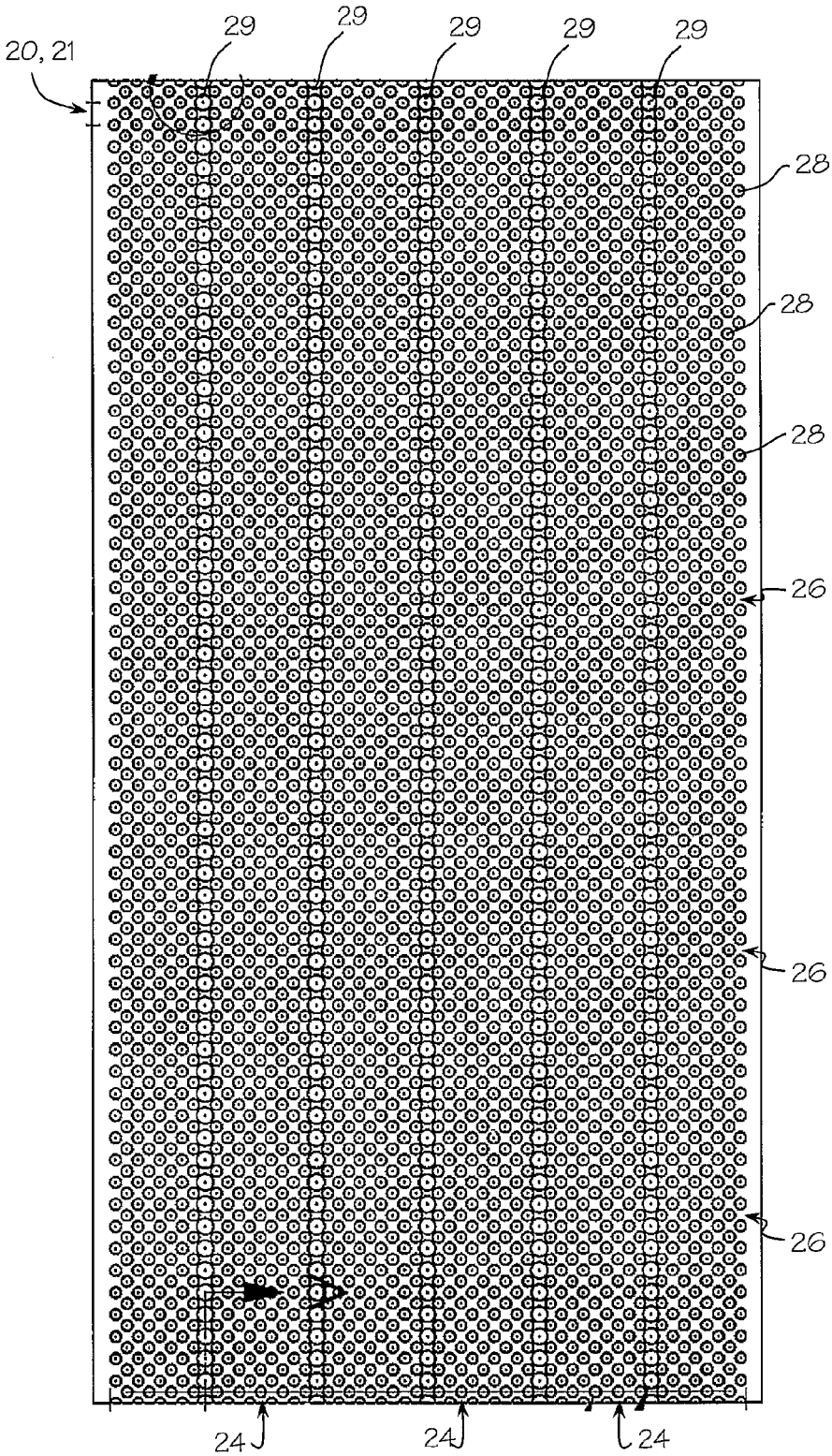
FIG. 9 is a plan view of a membrane or drainage panel for the framed wall construction, in accordance with a further embodiment of the invention.
Figure 10:
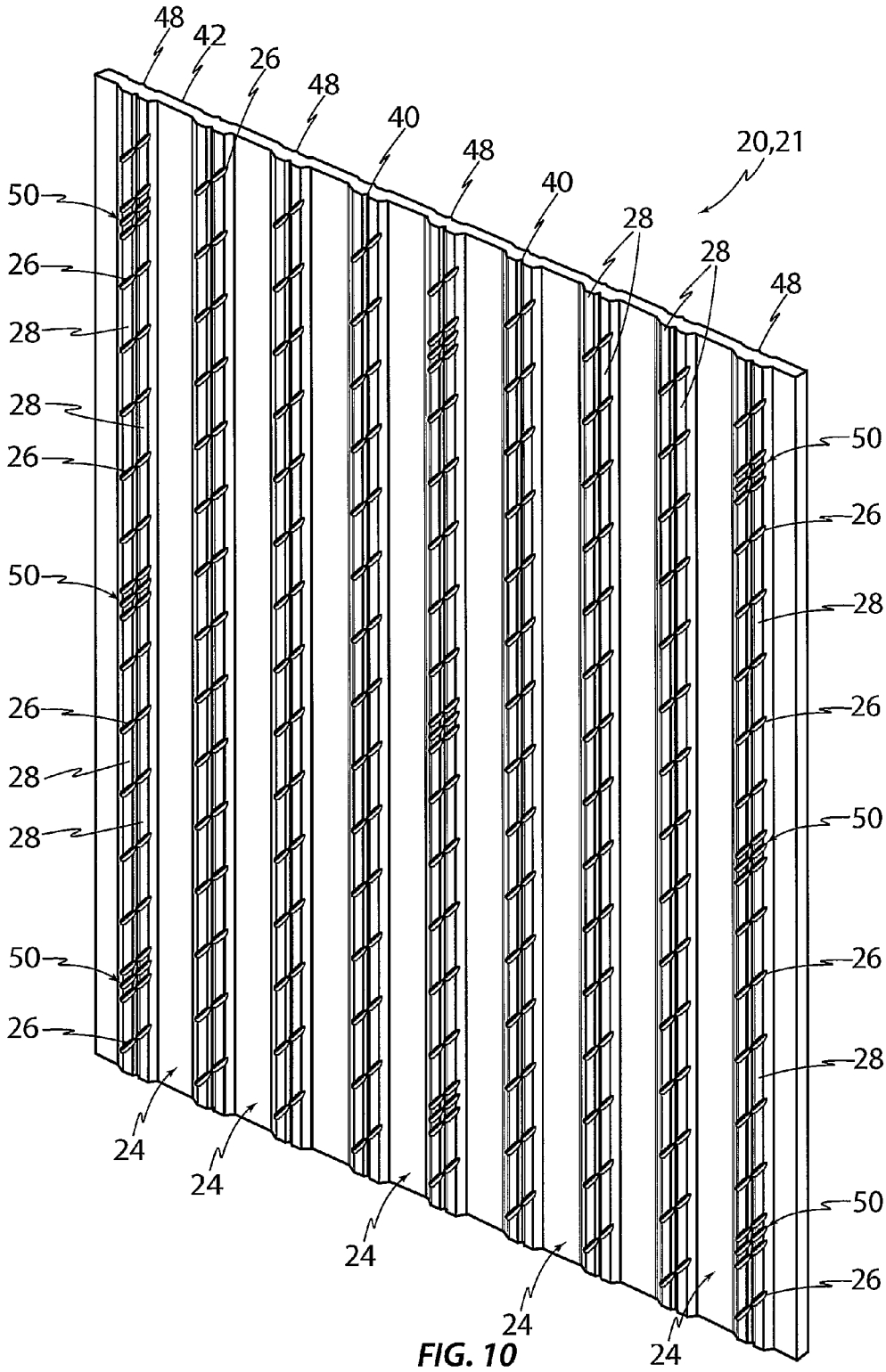
FIG. 10 is a front perspective view of a membrane or drainage panel for a framed wall construction, in accordance with a further embodiment of the invention.
Figure 11:
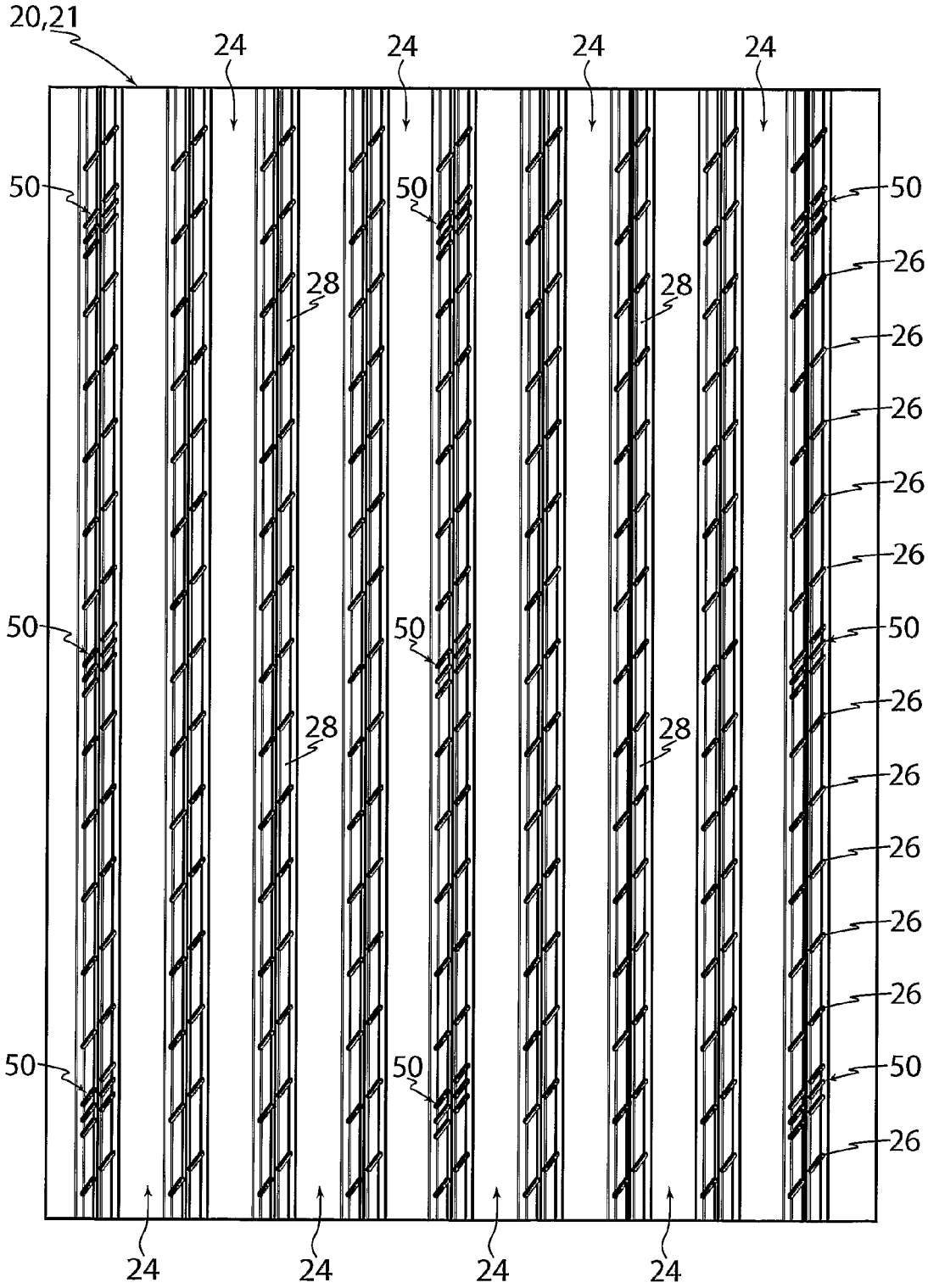
FIG. 11 is a plan view of the membrane or drainage panel of FIG. 10.

A further variation of the first and second embodiments is shown in FIG. 9. In a preferred form of this embodiment, the membrane 20 or drainage panels 21 are structurally similar to the first and second embodiments, differing primarily in the shape and pattern of the lands 28. In this respect, the lands are now round as well as regularly staggered to define both a zigzag path for both the primary and secondary drainage channels 24, 26. Similarly, the lands corresponding to standard stud locations are also larger in diameter to facilitate a larger area for nailing and/or screwing as well as indicating the stud positions.

In this preferred form, both the primary and secondary drainage channels have a substantially constant depth of approximately 3/32" (1.5 mm). Each smaller land has a diameter of approximately 4/5" (20 mm) and a generally constant spacing of approximately 4/5" (20 mm) from its horizontally or vertically adjacent land.

Yet a further variation of the first and second embodiments is shown in FIGS. 10 to 13. In a preferred form of this embodiment, the membrane 20 or drainage panels 21 are structurally similar to the first and second embodiments, again differing primarily in the shape and pattern of the lands 28. In particular, the column of lands are now regularly spaced and include longitudinally extending V-shaped grooves 40 disposed on their front surfaces.

The lands are preferably 4/5" (20 mm) wide and regularly spaced at approximately 1 3/5" (40 mm) between groove centers. Moreover, each land has a constant depth of approximately 3/32" (2.5 mm) and again may have transitional chamfered portions 34 (not shown) in order to assist the adhesion of the sealing tape 32.

Figure 12:
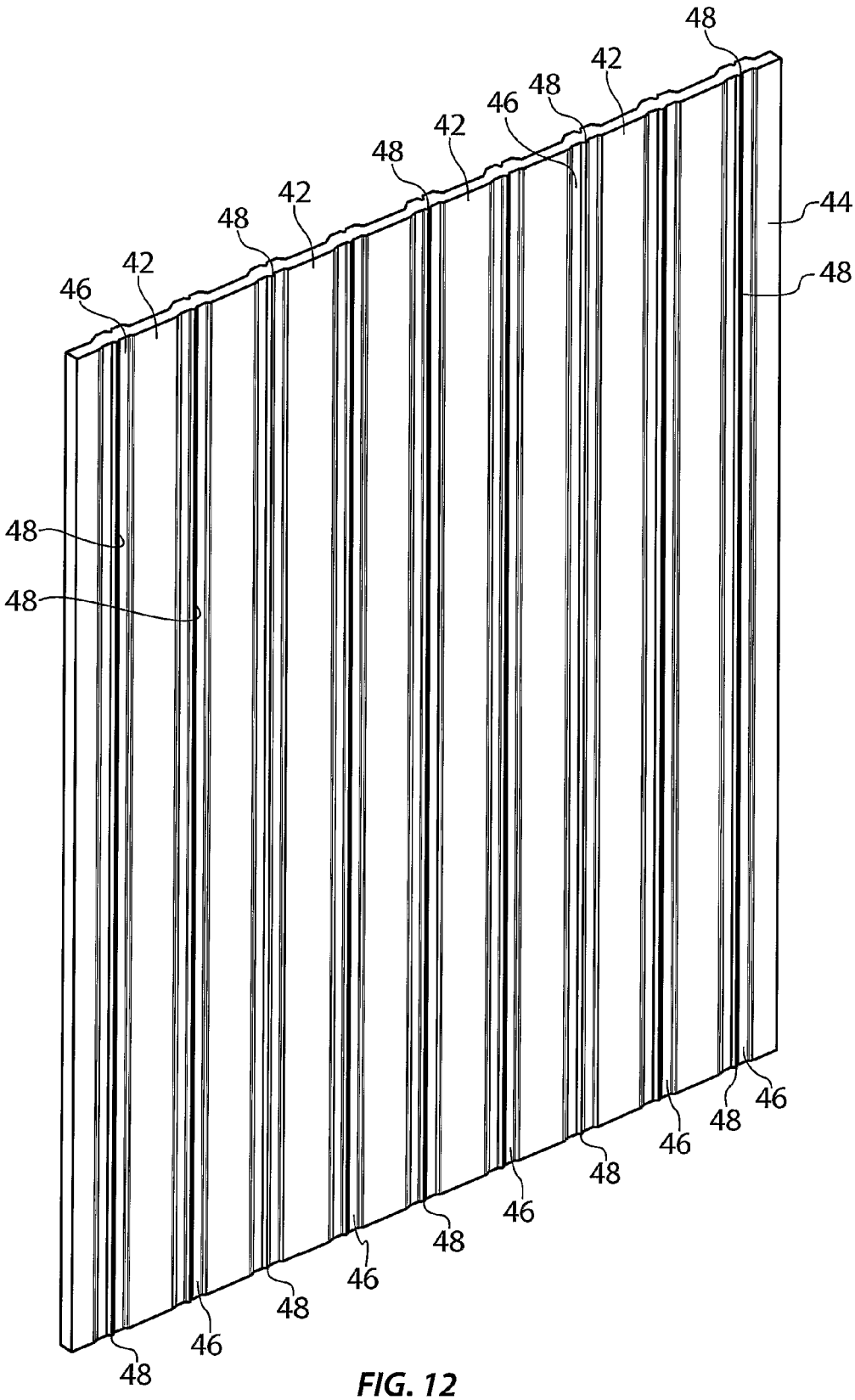
FIG. 12 is a rear perspective view of the membrane or drainage panel of FIG. 10.
Figure 13:
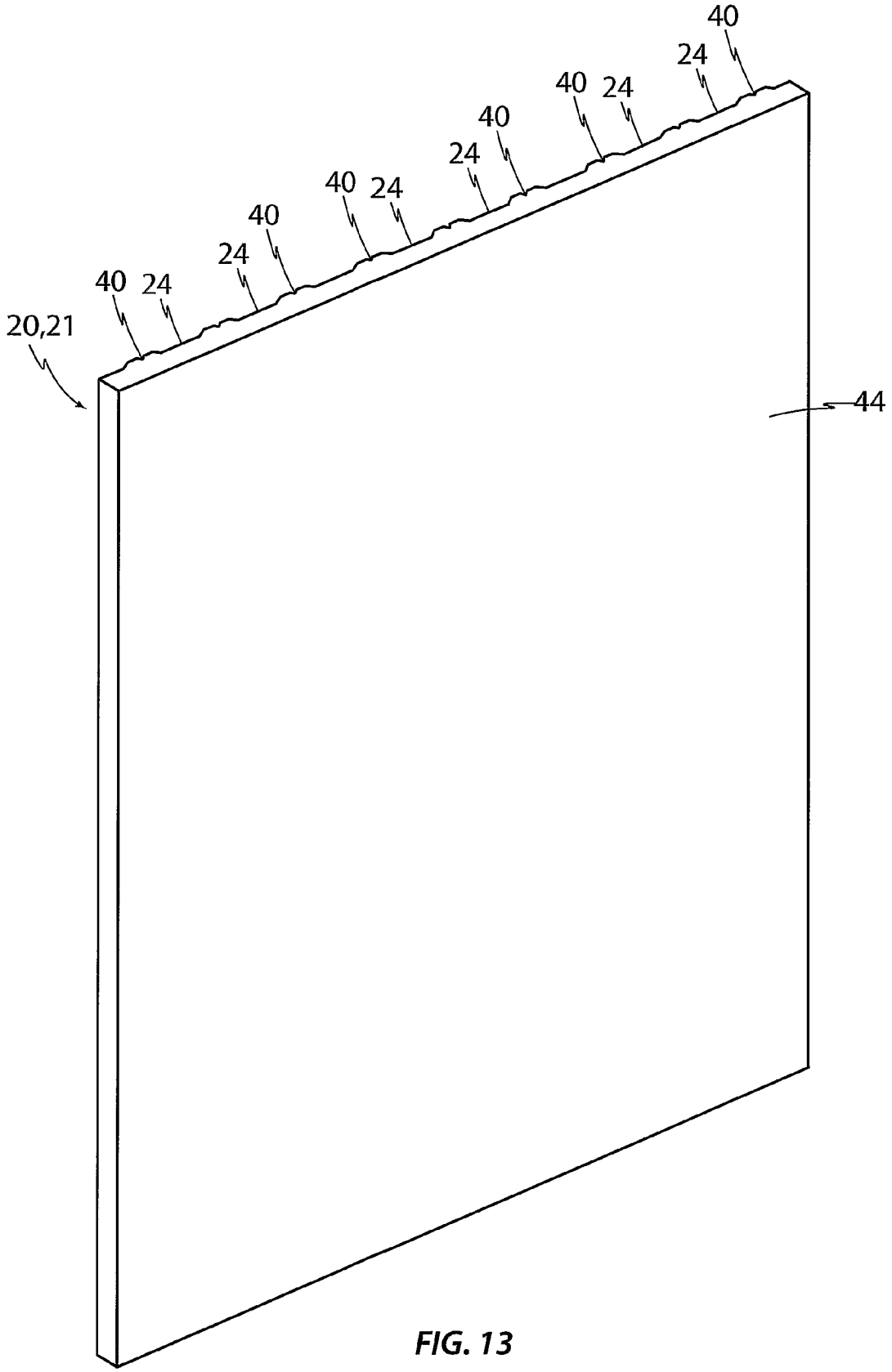
FIG. 13 is a rear perspective view of an alternate form of the membrane or drainage panel of FIG. 10.

It should be noted that the V-shaped grooves 40, which are approximately 1 mm deep, serve two primary functions. First, they provide a physical indication of nailing positions. Second, if rolling or embossing is used to form the primary drainage channels 24 in relatively thin membranes or panels, then corresponding channel protrusions 42 will be similarly formed on the rear surface 44. As best shown in FIG. 12, this in turn will result in a number of cavities 46 being defined between adjacent pairs of channel protrusions 42. As a result, the rear surface of the membrane 20 or drainage panel 21 will not be planar. Therefore, to support the cavities 46 during installation against the frame 12 or structural panels 18, V-shaped supporting protrusions 48 are provided in the centre of each cavity 46, which are formed as a result of the forming the complementary V-shaped grooves 40 on the front surface. Therefore, upon nailing at the center of each land, the cavity 46 will be supported and the membrane 20 or drainage panel 21 will retain its cross sectional shape during and post installation.

Of course, if the membrane or panel is of sufficient depth the channel protrusions 42 and supporting protrusions 48 will not be formed and the rear surface 44 will remain generally planar. This is best illustrated in the alternate form shown in FIG. 13.

It will be noted that the secondary drainage channels 26 of this embodiment are 'shallower' then the primary drainage channels 24 and therefore will not result in complementary formations on the rear surface. Also some of the secondary drainage channels 26 are now grouped in threes. It is proposed that these grouped secondary drainage channels, which have been assigned reference numeral 50, are preferably disposed on every fourth vertical column of lands, which in turn, correspond to standard stud locations of the frame, thereby further advantageously providing an indication of nailing locations. It should be understood, however, that in other preferred forms the grouped secondary channels 50 may be disposed on every third or even fifth column of lands, depending on the stud spacing of the frame.

The above-described alternate forms of the first and second embodiment all demonstrate the variations that may be made to the shape and pattern of the lands to equally provide the drainage benefits of the present invention, whilst providing additional benefits depending on the installation application.

Advantageously, the preferred embodiments, and variations thereof, provide a framed wall structure and associated method of construction, which is relatively fast and cost-effective to implement, structurally sound, substantially impervious to water impregnation and therefore relatively durable. In these and other respects, the invention represents a practical and commercially significant improvement over the prior art.

Although the invention has been described with reference to specific examples, it will be appreciated by those skilled in the art that the invention may be embodied in many other forms.

The claims defining the invention are as follows:

1. A drainage panel for a framed wall construction, said drainage panel being substantially rigid and comprising:

a substantially water-resistant front surface;

a plurality of spaced apart primary drainage channels recessed into said front surface to facilitate drainage of water between said drainage panel and a cladding material affixed to said front surface;

a plurality of spaced apart secondary drainage channels recessed into said front surface, said secondary drainage channels extending obliquely between at least some adjacent pairs of the primary drainage channels in a manner such that the secondary drainage channels zigzag horizontally across the front surface;

wherein said primary and secondary drainage channels are recessed into said front surface to define a plurality of raised upper lands, wherein the primary and secondary drainage channels are configured in a manner such that the density of the raised upper lands is greater along one or more vertical axis are adapted to that correspond to stud locations on a framed wall;

wherein each raised upper land has an upper surface, wherein the combined area of the upper surface of the raised upper lands is greater than the area of the drainage channels;

wherein said front surface is at least partially permeable to air and water vapor while being substantially impermeable to water in its liquid form, wherein the drainage panel provides structural support for the framed wall construction.

2. The drainage panel according to claim 1, wherein said secondary drainage channels extending generally transversely to said primary drainage channels and intersecting with at least some adjacent pairs thereof, said drainage channels facilitate drainage of water between said drainage panel and said cladding material.

3. The drainage panel according to claim 2, wherein said secondary drainage channels direct water between said primary drainage channels.

4. The drainage panel according to claim 2, wherein said secondary drainage channels provide cross ventilation between at least some adjacent pairs of said primary drainage channels.

5. The drainage panel according to claim 2, the raised upper lands comprise an array of relatively raised and substantially planar lands, with respect to said drainage channels, said array of lands being in the form of a series of horizontal rows and vertical columns.

6. The drainage panel according to claim 5, wherein said framed wall construction includes one or more vertical frame elements and wherein said front surface includes at least one of said vertical column of lands substantially aligning with at least one vertical frame element during assembly of said wall construction.

7. The drainage panel according to claim 2, wherein said primary and secondary channels are roll-formed or embossed into said front surface.

8. The drainage panel according to claim 2, wherein said primary and secondary channels are cast, machined or extruded into said front surface.

9. The drainage panel according to claim 1, wherein said primary drainage channels are configured in use, to extend substantially vertically along said drainage panel.

10. The drainage panel according to claim 1, wherein said front surface includes indicia to indicate fastening locations.

11. The drainage panel according to claim 1, wherein the width of each primary drainage channel allows an adhesive sealing tape to closely follow the surface profile of said front surface to provide a seal that prevents, or at least minimizes, moisture penetrating along the adhesive tape line.

12. The drainage panel according to claim 1, wherein said drainage panel is substantially formed from wood, wood composite, Oriented Strand Board, plastics, other composite barriers, fiber reinforced cement or a combination thereof.

13. The drainage panel according to claim 1, wherein said front surface includes a hydrophobic film or coating selected from the group consisting of substantially water repellent cellulosic material, perforated polymer film, spunbonded polymer sheet or a combination thereof.

14. The drainage panel according to claim 13, wherein said hydrophobic film or coating includes siloxane.

15. A wall frame construction comprising:

a generally vertically orientated frame;

a planar layer of a drainage panel according to claim 1 fixedly attached to and substantially covering said frame; and a cladding material substantially covering said drainage panel.

16. The framed wall construction according to claim 15, wherein said cladding material includes a cementitious barrier, oriented strandboard, plywood, metal, masonry or a combination of these.

17. The framed wall construction according to claim 15, wherein said cladding material includes at least one cladding panel substantially formed from fiber-reinforced cement.

* * * * *